US009294832B2

(12) United States Patent
Suvanto et al.

(10) Patent No.: US 9,294,832 B2
(45) Date of Patent: Mar. 22, 2016

(54) APPARATUS

(75) Inventors: Mikko Veli Aimo Suvanto, Tampere (FI); Koray Ozcan, Farnborough (GB)

(73) Assignee: Nokia Technologies Oy, Espoo (FI)

( * ) Notice: Subject to any disclaimer, the term of this patent is extended or adjusted under 35 U.S.C. 154(b) by 544 days.

(21) Appl. No.: 12/459,233

(22) Filed: Jun. 29, 2009

(65) Prior Publication Data

US 2011/0268292 A1 Nov. 3, 2011

(51) Int. Cl.
*H04R 1/02* (2006.01)
*H04R 1/32* (2006.01)

(52) U.S. Cl.
CPC ..... *H04R 1/326* (2013.01)

(58) Field of Classification Search
CPC ..... H04N 1/2112; H04N 1/0058; H04N 1/00981; H04N 1/00989; H04N 2101/00; H04N 5/225; H04N 5/2628; H04N 5/50; H04R 17/08; H04R 25/502; H04R 1/236
USPC ..... 381/92, 337, 380, 382, 369, 173, 345, 381/373, 372, 371; 181/126–129; 367/7, 8, 367/10; 340/545.7, 456, 604
See application file for complete search history.

(56) References Cited

U.S. PATENT DOCUMENTS

| | | | | |
|---|---|---|---|---|
| 6,412,593 | B1 * | 7/2002 | Jones | 181/129 |
| 8,090,134 | B2 * | 1/2012 | Takigawa et al. | 381/373 |
| 8,155,717 | B1 * | 4/2012 | Watson | 455/575.3 |
| 2006/0153414 | A1 | 7/2006 | Liao | 381/371 |
| 2007/0165878 | A1 | 7/2007 | Konagai | 381/89 |
| 2008/0013773 | A1 * | 1/2008 | Yang | 381/379 |
| 2009/0045042 | A1 * | 2/2009 | Browne et al. | 204/157.15 |
| 2010/0172531 | A1 * | 7/2010 | Burns | 381/345 |

FOREIGN PATENT DOCUMENTS

| | | | | |
|---|---|---|---|---|
| CN | 101026904 | A | 8/2007 | |
| CN | 101336559 | A | 12/2008 | |
| EP | 2071872 | * | 6/2009 | H04R 25/00 |
| EP | 2071872 | A1 | 6/2009 | |
| JP | 62283273 | A | 12/1987 | |
| WO | WO 2007/054589 | * | 5/2007 | H04R 25/00 |
| WO | WO-2007/054589 | A2 | 5/2007 | |
| WO | WO-2007/085307 | A1 | 8/2007 | |

* cited by examiner

*Primary Examiner* — Lun-See Lao
(74) *Attorney, Agent, or Firm* — Harrington & Smith

(57) ABSTRACT

Apparatus including: an acoustic transducer, and a sound channel coupled to the acoustic transducer, the sound channel including an element having a shape that is electrically controllable, wherein the shape of the element is electrically controllable to change the acoustic properties of the sound channel.

29 Claims, 7 Drawing Sheets

APPARATUS

TECHNICAL FIELD

The present invention relates to an apparatus. The invention further relates to, but is not limited to, an apparatus for use in mobile devices.

BACKGROUND

Many portable, devices, for example mobile telephones, contain a number of acoustic transducers, such as microphones, earpieces and speakers. Such transducers are key components in mobile phone audio/acoustic design. Generally, there will be one or more sound channels or back cavities associated with each acoustic transducer. Such sound channels can ensure a certain frequency response is obtained for the transducer, and must be carefully designed as part of the mechanical configuration of the device hardware. Small changes in the size and configuration of the sound channels or cavities can have a large effect on the acoustic properties of the combined transducer/sound channel.

In known acoustic transducer configurations, the mechanical design of the sound channels is fixed at the point of hardware design and manufacture of the device is completed, and cannot be later adapted during use for a specific purpose or desired configuration. Instead, the desired acoustic properties are achieved by filtering the electrical signal representing the sound output before the signal is applied to the transducer. Typically, this requires the use of significant processing power, commonly provided by dedicated digital signal processors (DSPs).

Commonly, certain limitation and optimization modifications of the acoustic response of the transducer can be carried out in the DSP, in order to adapt the acoustic properties, as required during use of the device. However, this approach has problems, and it is difficult to overcome the restrictions imposed by the mechanical design of the transducer.

An example restriction imposed by the mechanical design is that certain configurations of directional microphone require two sound outlets designed in hardware around the microphone module. In some conditions, directional microphones are known to have better performance compared to omni-directional microphones. However, the reverse may be true under different conditions, for example directional microphones are known to be sensitive to windy conditions. As the hardware design of the microphone is fixed, any adaptation to the current conditions must be provided electronically.

Similarly, known earpiece designs may be conventional or leak tolerant. A true and efficient leak tolerant earpiece design provides an almost constant experience for playback of the downlink audio in different environmental conditions where a user seals the device containing the earpiece against their ear, where the seal achieved may not be perfect. Due to the leak tolerant nature of the earpiece, the leak between the handset and user's ear is almost not noticeable.

However, the mechanical design of an earpiece for a leak tolerant design is challenging, and a conventional design cannot be directly converted to leak tolerant design unless the mechanical design of the earpiece is reconsidered.

However, in some situations a leak tolerant earpiece design might not be preferred; for example, some users prefer a boosted low frequency response which is possible when a conventional earpiece design is provided in the handset. In addition, conventional earpiece designs provide a passive amplification which can sound louder if the user seals the handset against their ear very well.

According to current designs, the hardware integration requirements of the earpiece are different for leak-tolerant and conventional designs, and it is difficult, if not impossible, to configure a conventional earpiece to act as a leak tolerant earpiece once the hardware design has been fixed.

Other examples include handsfree speakers and other accessories where headsets are designed as open or closed back.

Thus, it would be beneficial to be able to adapt the mechanical hardware design of the transducer to adapt the acoustic properties during use of the device according to a desired operating mode for a device containing the transducer.

However, changing the properties of acoustic transducer, and especially miniature ones, is not a simple task. Previous attempts to provide flexibility in the configuration of transducers have generally required multiple transducers to be integrated into the system, and the inputs/outputs of the multiple transducers may then be combined through processing in a DSP to produce the required effect.

As discussed above, the frequency response of the transducer is dependent on the size and shape of the sound channels and cavities associated with the transducer. Thus, in known devices, the frequency response of transducers is fixed along with the integration of the hardware into a device. However, there exist situations in which it could be advantageous to be able to modify the frequency response.

For example, most of the energy of wind noise is known to be at low frequencies. Therefore, an omni-directional microphone's performance may also be poor in windy conditions, if it is designed to pick up low frequency sounds.

The requirements for acoustical properties of a speaker, or an earpiece, may vary depending on the situation. This can cause problems especially in applications where there is not enough resources (power, computing power) available to fix the output electrically.

However, if it were possible to modify the hardware configuration of the transducer, improved performance could be realised without processor intensive filtering.

In addition, it is common in current telephone applications to use narrow band codecs in which only a relatively small range of frequencies are recorded and transmitted over the phone network. However, some operators provide for the use of wideband codecs, in which a much larger range of frequencies are used. In order to support the use of wideband codecs, the handset should include hardware integration of transducers that support wideband operation. However, transducers optimized for wideband codecs may no longer be ideal for use with narrowband codecs, and vice versa. It would therefore be advantageous if it were possible to modify the hardware integration of the transducer during use to be optimized for operation with either wideband or narrow band codecs as required.

SUMMARY

It is an aim of at least some embodiments of the invention to address one or more of these problems.

According to an aspect of the invention, there is provided an apparatus comprising an acoustic transducer, and a sound channel coupled to the acoustic transducer, the sound channel comprising an element having a shape that is electrically controllable, wherein the shape of the element is electrically controllable to change the acoustic properties of the sound channel.

The apparatus may further comprise a controller configured to control the shape of the element.

According to some embodiments, the element may be formed of an electroactive polymer. The shape of the element may be electrically controllable between a first shape, in which the sound channel is open, and a second shape, in which the sound channel is blocked.

The apparatus may comprise an audio output and/or input device, and changing the acoustic properties of the sound channel may comprise changing the frequency response of the audio output and/or input device.

The acoustic transducer may comprise a microphone or a speaker.

The apparatus may further comprise a processor configured to decode audio data for the transducer using one of at least two audio codecs, the controller operable to control the shape of the element in dependence on the audio codec used to decode the audio data.

The apparatus may comprise two sound channels coupled to the microphone and configured to provide directional operation of the microphone, the element electrically controllable to block one of said sound channels to thereby cause the microphone to operate as an omni-directional microphone.

The apparatus may comprise a microphone array of at least two microphones, each microphone coupled to a respective sound channel, the microphone array is configured to provide directional operation, the element electrically controllable to block one of said sound channels to thereby cause the microphone array to operate as an omni-directional microphone.

The sound channel may be coupled to a sound cavity.

The apparatus may further comprise a microphone located adjacent to the speaker, the controller coupled to the microphone and configured to control the shape of the element in dependence upon a signal generated by the microphone.

The controller may be configured to control the shape of the element in dependence on a saturation level of the microphone.

The element may be controllable to form a water tight seal within the sound channel, the controller configured to control the shape of the element to seal the sound channel when a risk of water entering the sound channel is detected.

An electronic device may comprise the apparatus as described above.

According to a second aspect of the invention, there is provided a method comprising, in an apparatus comprising an acoustic transducer, and a sound channel coupled to the acoustic transducer, providing an element within the sound channel, the element having a shape that is electrically controllable, and electrically controlling the shape of the element to thereby change the acoustic properties of the channel.

Electrically controlling the shape of the element may comprise electrically controlling the shape of the element between a first shape, in which the sound channel is open, and a second shape, in which the sound channel is blocked.

Wherein the apparatus may comprise an audio output and/or input device, and electronically controlling the shape of the element may comprise changing the frequency response of the audio output and/or input device.

The method may further comprise decoding audio data for the transducer using one of at least two audio codecs, and electronically controlling the shape of the element in dependence on the audio codec used to decode the audio data.

The apparatus may comprise two sound channels coupled to the microphone and may be configured to provide directional operation of the microphone, and electronically controlling the shape of the element may comprise electronically controlling the shape of the element to block one of said channels to thereby cause the microphone to operate as an omni-directional microphone.

The apparatus may comprise a microphone array of at least two microphones, each microphone may be coupled to a respective sound channel, the microphone array preferably configured to provide directional operation, and electronically controlling the shape of the element may comprise electronically controlling the shape of the element to block one of said channels to thereby cause the microphone array to operate as an omni-directional microphone.

The apparatus may further comprise a microphone located adjacent to the speaker, and the method may further comprise electrically controlling the shape of the element in dependence upon a signal generated by the microphone.

The method may further comprise electrically controlling the shape of the element in dependence on a saturation level of the microphone.

The method may further comprise electrically controlling the element to form a water tight seal within the sound channel based on detection of a risk of water entering the sound channel.

According to a third aspect of the invention, there is provided a computer readable storage medium encoded with instructions that, if executed by a computer, perform a process, the process comprising in an apparatus comprising an acoustic transducer, and a sound channel coupled to the acoustic transducer, the sound channel comprising an element having a shape that is electrically controllable, electrically controlling the shape of the element to thereby change the acoustic properties of the channel.

According to a forth aspect of the invention, there is provided an apparatus comprising transducing means, and a sound channel coupled to the transducing means, the sound channel comprising electrically controllable shape changing means for changing the acoustic properties of the sound channel.

BRIEF DESCRIPTION OF THE DRAWINGS

For better understanding of the present invention, reference will now be made by way of example to the accompanying drawings in which.

DETAILED DESCRIPTION

Figure 1:
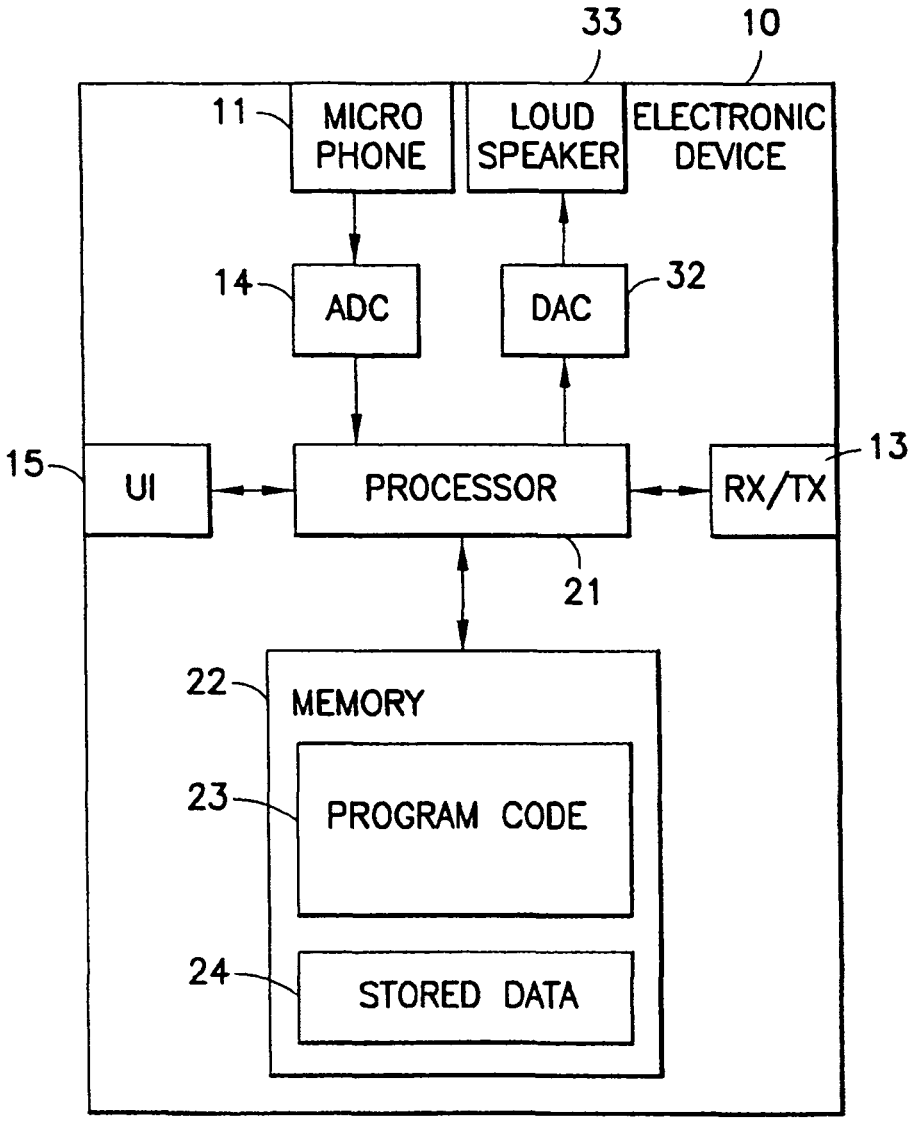
FIG. 1 shows schematically an electronic device employing embodiments of the invention.

The following describes in further detail suitable apparatus and possible mechanisms for the provision of transducers having changeable acoustic properties. In this regard reference is first made to FIG. 1 which shows a schematic block diagram of an exemplary apparatus or electronic device 10, which may incorporate transducers having changeable acoustic properties according to some embodiments.

The electronic device 10 may for example be a mobile terminal or user equipment of a wireless communication system.

The electronic device 10 comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (TX/RX) 13, to a user interface (UI) 15 and to a memory 22.

The processor 21 may be configured to execute various program codes. The implemented program codes may comprise encoding code routines. The implemented program codes 23 may further comprise an audio decoding code. The implemented program codes 23 may be stored for example in the memory 22 for retrieval by the processor 21 whenever needed. The memory 22 may further provide a section 24 for storing data.

The user interface 15 may enable a user to input commands to the electronic device 10, for example via a keypad, and/or to obtain information from the electronic device 10, for example via a display. The transceiver 13 enables a communication with other electronic devices, for example via a wireless communication network. The transceiver 13 may in some embodiments of the invention be configured to communicate to other electronic devices by a wired connection.

It is to be understood again that the structure of the electronic device 10 could be supplemented and varied in many ways.

A user of the electronic device 10 may use the microphone 11 for inputting speech, or other sound signal, that is to be transmitted to some other electronic device or that is to be stored in the data section 24 of the memory 22. A corresponding application has been activated to this end by the user via the user interface 15. This application, which may be run by the processor 21, causes the processor 21 to execute the encoding code stored in the memory 22.

The analogue-to-digital converter 14 may convert the input analogue audio signal into a digital audio signal and provides the digital audio signal to the processor 21.

The processor 21 may then process the digital audio signal in the same way as described with reference to the description hereafter.

The resulting bit stream is provided to the transceiver 13 for transmission to another electronic device. Alternatively, the coded data could be stored in the data section 24 of the memory 22, for instance for a later transmission or for a later presentation by the same electronic device 10.

The electronic device 10 may also receive a bit stream with correspondingly encoded data from another electronic device via the transceiver 13. In this case, the processor 21 may execute the decoding program code stored in the memory 22. The processor 21 may therefore decode the received data, and provide the decoded data to the digital-to-analogue converter 32. The digital-to-analogue converter 32 may convert the digital decoded data into analogue audio data and outputs the analogue signal to the loudspeakers 33. Execution of the decoding program code could be triggered as well by an application that has been called by the user via the user interface 15.

In some embodiments the loudspeakers 33 may be supplemented with or replaced by a headphone set which may communicate to the electronic device 10 or apparatus wirelessly, for example by a Bluetooth profile to communicate via the transceiver 13, or using a conventional wired connection.

Some embodiments allow the hardware integration of the transducers, such as the microphone 11 or the speaker 33, to be controlled by adapting and controlling elements comprising a material whose shape is modified when a voltage is applied.

An example of a material that has a shape that is modifiable electronically is an electroactive polymer (EAP), but any such material may be used. By incorporating elements of electrically modifiable materials, such as EAP, in a device it is possible to control the properties of the acoustic system and transducers by electronically changing the dimensions of the acoustic outlets, channels and cavities by using electrically modifiable materials. Acoustic channels and outlets may even be closed completely using the described technique.

Other electrically modifiable materials that may be used include piezoelectric materials and shape memory materials.

Some embodiments may be especially useful in the case of components based on micro electro-mechanical systems (MEMS) technology, where the dimensions are usually small, and achieving a significant relative difference in the dimensions of a channel requires only a minimal absolute change. In some embodiments, the described functionality may be fabricated into components using MEMS technology and techniques.

Figure 2:
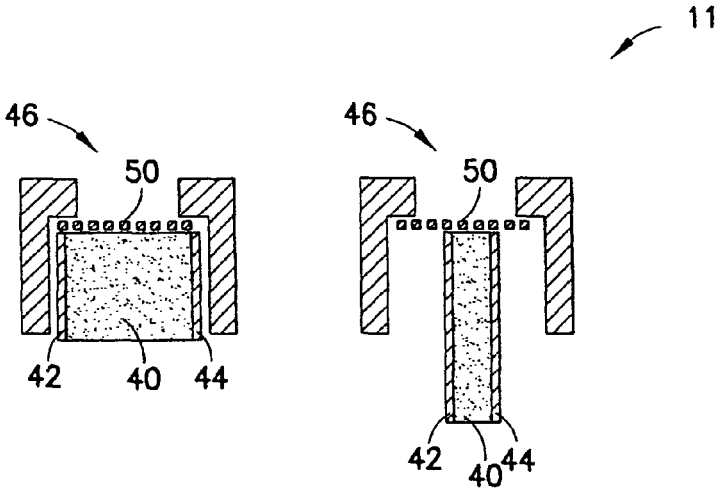
FIG. 2 shows schematically a microphone outlet according to some embodiments.

The general operation of a transducer according to some embodiments is shown in FIG. 2. A microphone outlet, such as for microphone 11 comprises a sound channel 46, in this case a single sound hole, through which sound waves can enter the microphone 11. Within the sound channel 46 is placed an element 40 formed from a electrically modifiable material. According to one embodiment, the element comprises an electroactive polymer comprising a passive elastomer film sandwiched between two electrodes 42, 44, although other electrically modifiable material arrangements may be used. A mesh, or grill, 50 is provided to protect the sound channel and to stop any foreign body from entering.

Applying a voltage across electrodes 42, 44 leads to an electrostatic force being generated. The force between the electrodes squeezes the elastomer film resulting in a change in the shape of the element 40. Thus, by controlling the voltage applied to the electrodes 42, 44 it is possible to change the shape such that the sound channel is blocked either completely or partially when the element fills the sound channel 46, or when element 40 is compressed channels 48 are opened to allow sound to enter the microphone.

According to some embodiments, a directional microphone has one or more sound ports, or sound channels 46, arranged to either side of a membrane such that sound entering the microphone through the two sound channels interferes, constructively for sound originating in the desired direction, and destructively for other directions. Thus, by incorporating the sound channels 46 as shown in FIG. 2 into the directional microphone design, the microphone may be operated as an omni-directional microphone by blocking the sound channel(s) 46 on one side of the membrane.

In a further mode of operation, the sound channel(s) 46 may be only partially blocked by the element 40, resulting in a change to the directional properties of the microphone 11.

Figure 3A:
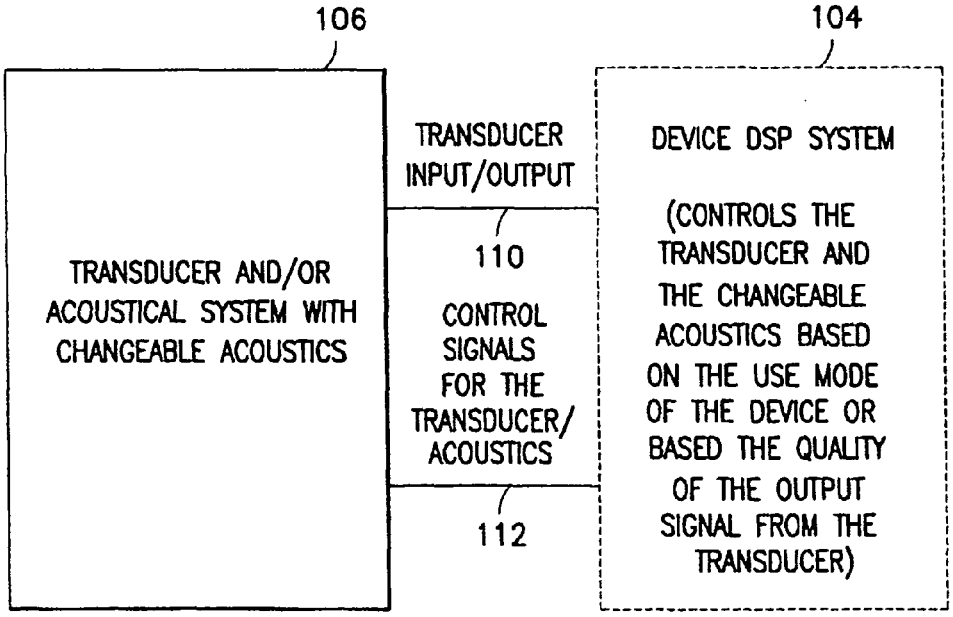
FIG. 3*a* shows an example topology for integrating a transducer into a device according to some embodiments.
Figure 3B:
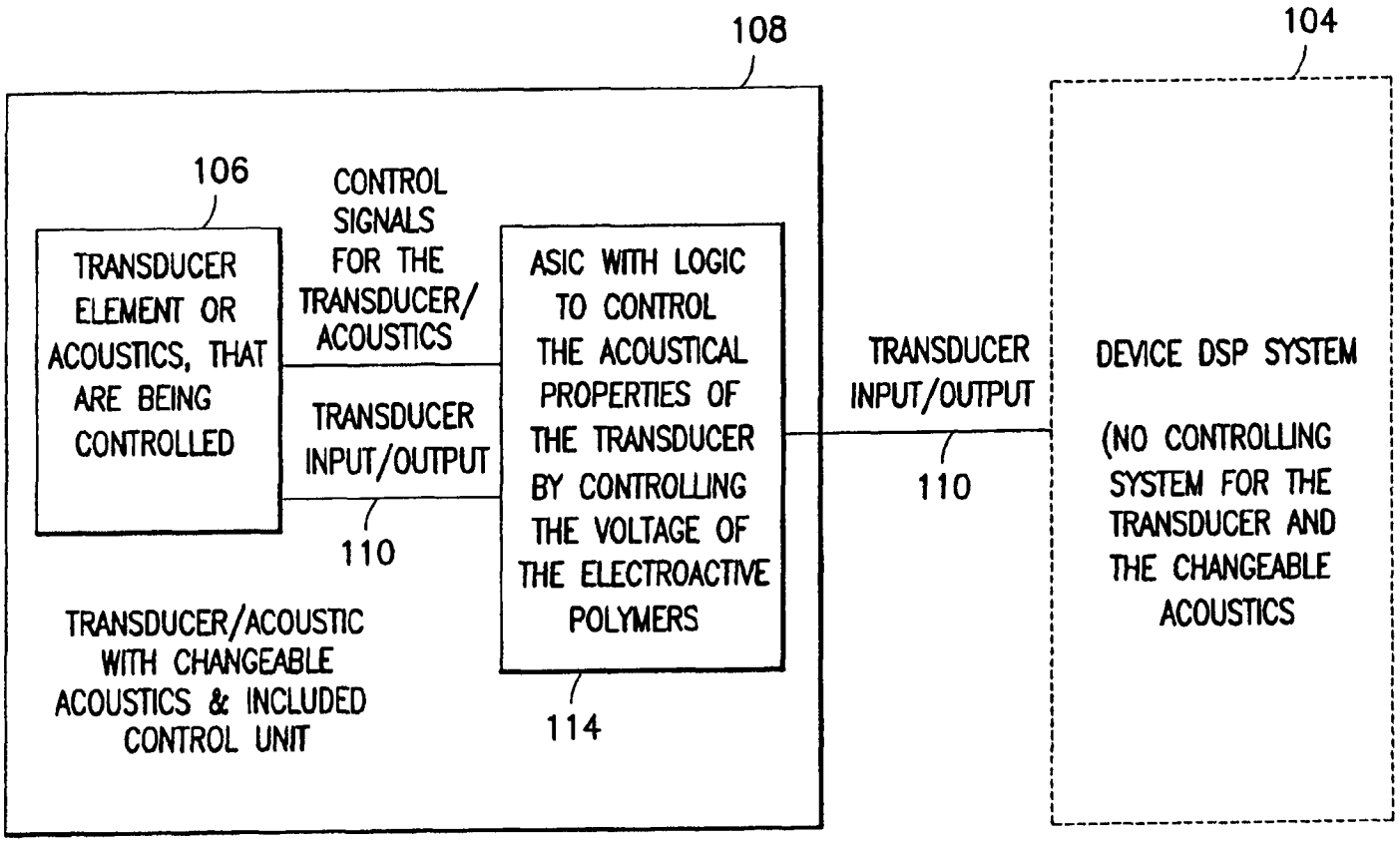
FIG. 3*b* shows a further example topology for integrating the transducer into the device according to some embodiments.

FIGS. 3*a* and 3*b* show two examples of how a transducer according to some embodiments can be integrated into a larger system. The system of FIG. 3*a* comprises a Device DSP system 104 having first and second input/output ports, the first and second input/output ports coupled to a transducer with changeable acoustics 106. In the system of FIG. 3*a*, the DSP is configured to drive/receive a transducer input/output signal 110 and to control the transducer's changeable acoustics via a control signal 112. Thus control of the transducer is performed within the device DSP system 104 according to software executed within the DSP system 104.

The system of FIG. 3*b* comprises a Device DSP system 104 having an input/output signal coupled to a combined transducer/control unit 108. The combined transducer/control unit 108 comprises an ASIC 114 having control logic for controlling the acoustical properties by controlling the voltages applied to the elements 40 in the transducer having changeable acoustics 106. The ASIC 114 has first and second input/output ports coupled to the transducer 106 and configured to provide the control signals 112 and the transducer input/output signal 110 to the transducer 106. The ASIC can determine the appropriate acoustical setting based on, for example, the quality of the audio signal from the transducer.

Alternatively, ASIC 114 may be replaced with a processor running suitably configured software, or any other logic circuit capable of providing the required control signals to the transducer 106.

Figure 4:
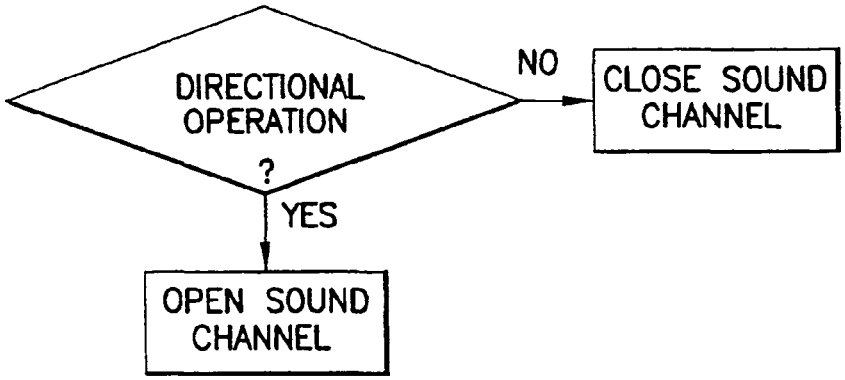
FIG. 4 shows a method according to some embodiments.

FIG. 4 shows a method of operation of a control system for a directional microphone shown in FIG. 2. In a first stage, it is determined whether it is desired for the microphone 11 to operate in directional mode. If so, a voltage is applied across electrodes 42, 44 causing the elastomer 40 to be compressed and opening the microphone inlet. However, if it is desired to operate the microphone in an omni-directional mode, a voltage across the electrodes is discharged, resulting in the elastomer 40 relaxing and blocking the microphone inlet.

According to some embodiments, the same concept of electrically changing the shape of a material could be used to perform acoustical switching inside a microphone 11. For example, the holes in a microphone back plate could be partially blocked in order to make the microphone membrane stiffer (thus reducing the sensitivity), enabling use of the microphone 11 in extremely high sound pressure levels (>>140 dB). Furthermore, acoustic channels inside a microphone 11 can be changed in order to change the sensitivity or frequency response. The frequency response could be changed for example so that the low frequency roll off point is shifted higher in frequency in order to reduce disturbances when wind noise or other saturation is detected. This could be done, for example, by creating a switchable sound port parallel to the microphone membrane to form an acoustical overpass filter for the membrane.

Figure 5:
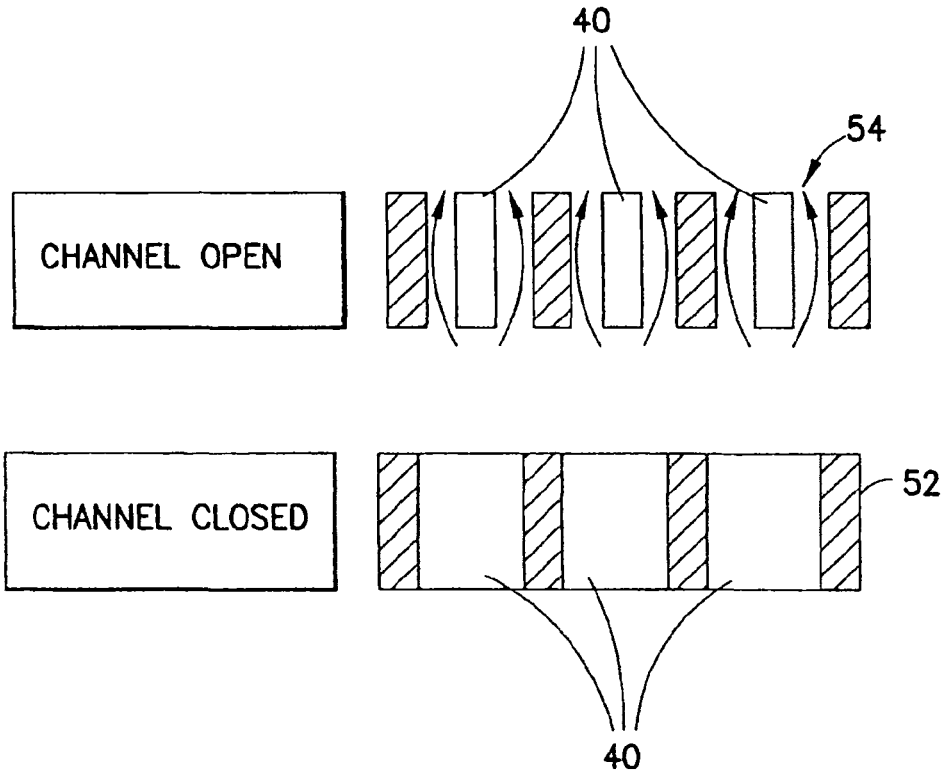
FIG. 5 shows a mesh having holes which can be opened and closed according to some embodiments.

An arrangement suitable for blocking holes in a microphone backplate is shown in FIG. 5. Backplate 52 includes one or more sound channels 54. An element 40 as described above is arranged within one or more of the sound channels 54 to allow the channels to be opened or selectively blocked or partially blocked, by electronic control of the element 40.

According to some embodiments, the frequency response of a speaker 33 can be controlled by changing the dimensions of acoustic channels associated with the speaker 33. Additional speaker/earpiece 33 back volumes can be taken in and out of use by blocking and opening a sound channel to it. This could be achieved, for example, using the arrangement described in relation to FIG. 5.

Figure 6:
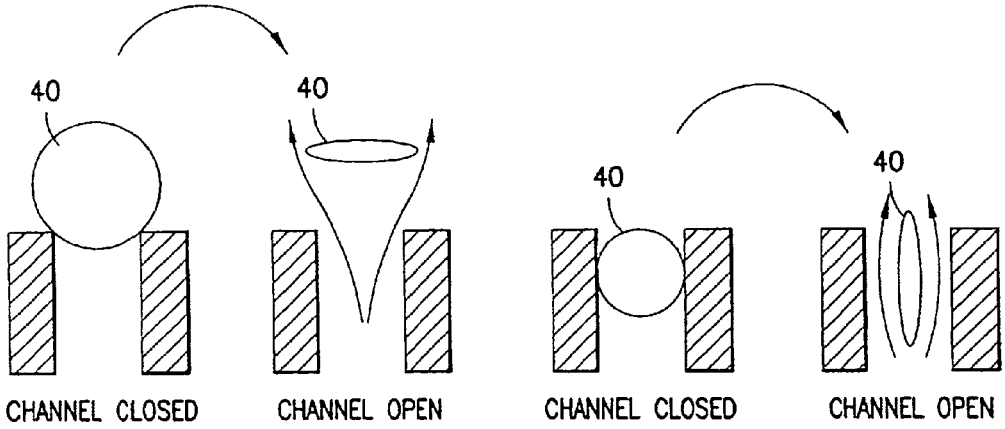
FIG. 6 illustrates two configurations for controlling the opening and closing of sound channels according to some embodiments.

Alternative arrangements for blocking individual sound channels are shown in FIG. 6. In one arrangement, the element 40 is arranged in front of an opening of the sound channel such that when no voltage is applied, the element blocks the opening. The shape of the element 40 changes upon activation to open the channel. In the other arrangement of FIG. 6, the element 40 is located within the channel, expanding to fill, and therefore block the channel, and when activated opening the channel.

According to some embodiments, a transducer 11, 33 may be designed to include some dedicated sound channels, including controllable elements 40, for use in conjunction with a wideband codec. When it is detected that a wideband codec is in use, the dedicated sound channels may be activated. This may have the effect of controlling the resonance frequency of the transducer so that the frequency bandwidth is either increased or decreased relative to the sound outlet(s) dimension in order to support both wideband and narrowband codecs. The elements 40 may be controlled automatically by software, for example executing on processor 21, based on the type of codec in use.

According to some embodiments, an earpiece could be design such that it can be converted into a leak tolerant design, or vice versa, by controlling the hole surface. Some embodiments supporting an earpiece that can operate in both leak tolerant and conventional modes is shown in FIG. 7.

Figure 7:
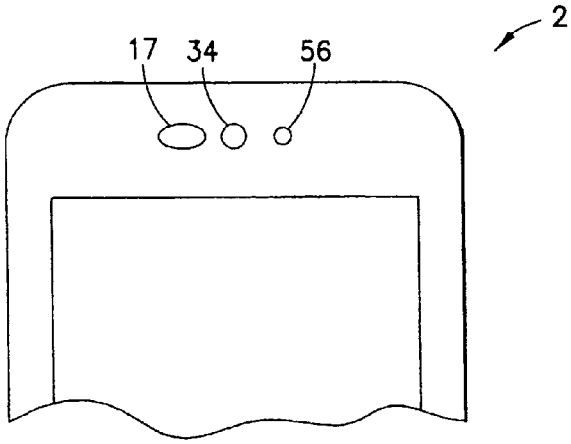
FIG. 7 shows an earpiece according to some embodiments.

The earpiece 2, shown in FIG. 7 comprises a main outlet 34 associated with the loud speaker 33. An omni-directional microphone 56 is integrated next to the main outlet 34. At least one leak hole 17 is also provided. The leak hole 17 comprises elements 40 (not shown) in order to allow the sound channels associated with the leak hole to be controllably blocked.

In use, the microphone 56 detects a sound pressure level that is relative to how well the user seals the earpiece against their ear. If a microphone signal exceeds a threshold level, then the leak holes 17 can be activated so that the user will experience a stable level for the downlink audio signal output by the speaker 33. The handset microphone 11 can also support earpiece playback because if the handset microphone detects ambient noise level exceeding certain threshold, the leak holes might be controlled accordingly.

According to some embodiments, the element 40 may be controlled based on an ambient noise level detected by the microphone 11, or by any other microphone present in the device, in order to adjust a playback level of the speaker 33. This provides a simple method to control the playback level based on ambient noise, and may require reduced processing resources compared to known methods.

Many modern mobile telephones include hands free, or conference call functionality to allow a call to be taken without the phone being held to the users ear. Some embodiments allow the hands free functionality to be improved by providing dedicated outlets for use in a hands free mode.

For example, some handsets may have a variable geometry, such as being foldable. Using elements 40 as described above would allow different sound channels to be activated or blocked automatically according to the geometry of the handset. Thus, for a foldable handset which may be operable in a hands free mode while folded, some outlets dedicated to hands free operation could be activated to increase bandwidth of the transducers when the handset is folded, for example a bass reflex port could be activated to support low frequency audio. When the handset is unfolded the dedicated hands free outlets could be disabled.

According to some embodiments, changing the properties of sound channels in a device can be also useful in the case of multifunctional transducers (for example a combined earpiece, speaker and vibration motor). Different properties are expected from the transducer's sound output in earpiece and speaker modes. Designing the transducer with sound channels including elements 40 according to the described embodiments allows the acoustic properties of the transducer to be changed electronically. The ability to change the acoustic properties of the transducer in this way can improve the sound quality significantly.

According to some embodiments, a microphone includes an acoustic overpass filter which operates to prevent mechanical saturation of the microphone. The acoustic overpass filter comprises a bypass hole from the back volume of the microphone to the front of the microphone membrane. Generally, the acoustic overpass filter should be located close to the microphone membrane and should consist of a short bypass channel.

Figure 8:
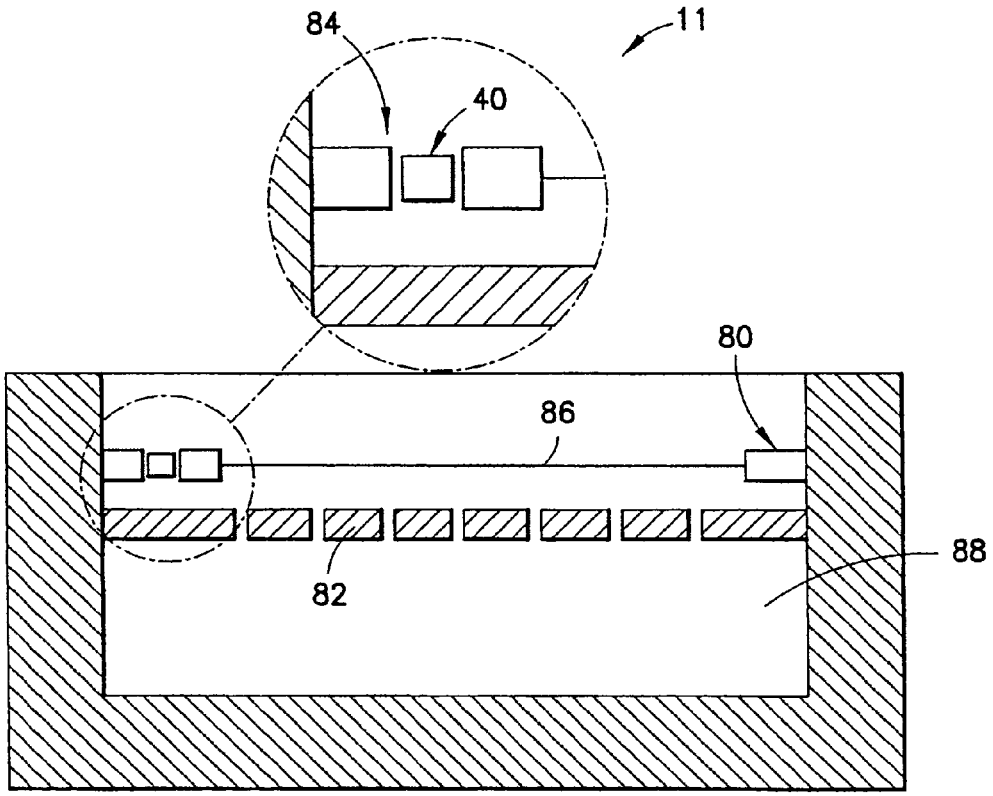
FIG. 8 shows a microphone according to some embodiments.

FIG. 8 shows a microphone including an acoustic overpass filter 84 according to some embodiments. The microphone 11 comprises a microphone membrane 86 which is held within a membrane support structure 80. A back plate 82 underlies the membrane 86, within a back volume 88. The acoustic overpass filter 84 comprises a short channel within the support structure 80. An element 40 is located within the acoustic overpass filter 84.

In use, the element 40 can be controlled such that the channel within the acoustic overpass filter 84 can be open or blocked, either completely or partially. Controlling the element thereby allows the sensitivity and/or frequency response of the microphone 11 to be adjusted.

Figure 10:
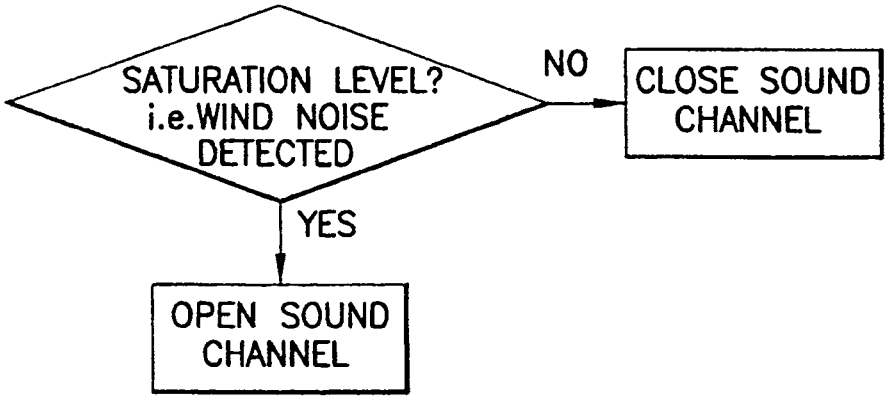
FIG. 10 shows a method according to some embodiments.

FIG. 10 shows an example method of operation for controlling the embodiment of FIG. 8. If it is detected that the microphone is nearing saturation level, for example due to wind noise being detected at the microphone, the element 40 is activated to open the sound channel, and activate the acoustic overpass filter. With the acoustic overpass filter active, the sensitivity of the microphone to the wind noise is reduced, preventing mechanical saturation of the microphone.

However, if the microphone is not near saturation level, the element 40 can be controlled to block the channel, and deactivate the acoustic overpass filter. Thus, the filter may be controlled by software based on the detection of distortion or saturation in the microphone signal.

In this way, it is possible for a high quality microphone having a low cut off frequency to be selectively switched for use in poor acoustic conditions in which it would otherwise become saturated.

Figure 9:
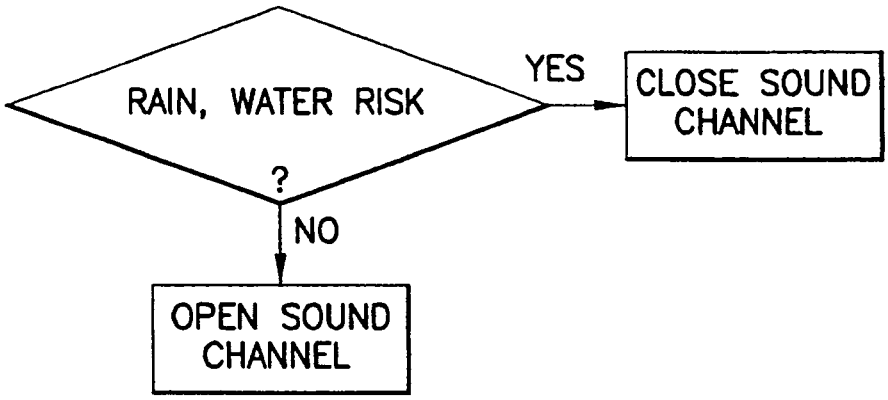
FIG. 9 shows a method according to some embodiments.

FIG. 9 shows a method according to some embodiments of the invention, in which elements 40 comprising material having a shape which is electrically controllable can be used to improve weatherproofing of a device. In particular, efforts have been made to produce weather proof, or waterproof, devices, for example mobile phones. However, it is necessary to provide sound outlets in such a device, and these outlets can allow water ingress into the device.

A device configured to implement the method of FIG. 9 includes elements 40 within the sound outlets of the device, and controllable to block the sound outlets. If a water risk is detected, for example if the device is submerged and water starts to enter the sound outlets, the elements are controlled to block the sound channel, and therefore seal the device against the water. According to some embodiments, the user of the device may place the device into a weather proof/waterproof mode in which the sound outlets are sealed against water ingress.

Some of the described embodiments may provide one or more advantages over prior art systems, such as improved sound quality, and the ability to change the audio parameters in hardware instead of requiring filtering of the signal in a DSP, for example processor 21, which can degrade the sound quality, thereby reducing the level of processing power required and improving battery life. Furthermore, some embodiments may allow the size of the transducers to be reduced allowing miniaturized implementations.

Thus, a user equipment may comprise one or more of the transducers as described above.

It shall be appreciated that the term user equipment is intended to cover any suitable type of wireless user equipment, such as mobile telephones, portable data processing devices or portable web browsers. Furthermore, it will be understood that the term acoustic sound channels is intended to cover sound outlets, channels and cavities, and that such sound channels may be formed integrally with the transducer, or as part of the mechanical integration of the transducer with the device.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GOSH, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. An apparatus comprising:

an acoustic transducer;

a sound channel coupled to the acoustic transducer, the sound channel comprising an element having a shape within the sound channel; and a controller configured to control the shape of the element to selectively cause the element to change a shape of the sound channel;

wherein the shape of the element is electrically controllable to change the acoustic properties of the sound channel based at least on partially changing the dimensions of the element.

2. The apparatus according to claim 1, wherein the element is formed of an electroactive polymer.

3. The apparatus according to claim 1, wherein the shape of the element is electrically controllable between a first shape, in which the sound channel is open, and a second shape, in which the sound channel is blocked.

4. The apparatus according to claim 1, wherein the apparatus comprises an audio output and/or input device, and wherein changing the acoustic properties of the sound channel comprises changing the frequency response of the audio output and/or input device.

5. The apparatus according to claim 1, wherein the acoustic transducer comprises a microphone.

6. The apparatus according to claim 1, wherein the acoustic transducer comprises a speaker.

7. The apparatus according to claim 1, further comprising a processor configured to decode audio data for the acoustic transducer using one of at least two audio codecs;

wherein the controller is operable to control the shape of the element in dependence on the audio codec used to decode the audio data.

8. The apparatus according to claim 5, wherein the apparatus comprises two sound channels coupled to the microphone and configured to provide directional operation of the microphone;

wherein the element is electrically controllable to block one of said sound channels to thereby cause the microphone to operate as an omni-directional microphone.

9. The apparatus according to claim 1, wherein the acoustic transducer of the apparatus comprises a microphone array of at least two microphones, each microphone coupled to a respective sound channel, the microphone array is configured to provide directional operation;

wherein the element is electrically controllable to block one of said sound channels to thereby cause the microphone array to operate as an omni-directional microphone.

10. The apparatus according to claim 1, wherein said at least one sound channel is coupled to a sound cavity.

11. The apparatus according to claim 1, wherein the acoustic transducer comprises a speaker, the apparatus further comprising a microphone located adjacent to the speaker, said controller coupled to the microphone and configured to control the shape of the element in dependence upon a signal generated by the microphone.

12. The apparatus according to claim 1, wherein the acoustic transducer comprises a microphone, said controller configured to control the shape of the element in dependence on a saturation level of the microphone.

13. The apparatus according to claim 1, wherein said element is controllable to form a water tight seal within the sound channel, said controller configured to control the shape of the element to seal the sound channel when a risk of water entering the sound channel is detected.

14. An electronic device comprising the apparatus of claim 1.

15. The apparatus according to claim 1, wherein the element is formed of a material in which the shape thereof is modified when a voltage is applied, wherein the material is one of an electrically modifiable material, a piezoelectric material, and a shape memory material.

16. A method comprising:

in an apparatus comprising an acoustic transducer, and a sound channel coupled to the acoustic transducer, providing an element within the sound channel, the element having a shape within the sound channel; and electrically controlling the shape of the element to selectively cause the element to change a shape of the sound channel to thereby change the acoustic properties of the channel based at least on partially changing the dimensions of the element.

17. The method of claim 16, wherein the element comprises an electroactive polymer.

18. The method of claim 16, wherein electrically controlling the shape of the element comprises electrically controlling the shape of the element between a first shape, in which the sound channel is open, and a second shape, in which the sound channel is blocked.

19. The method of claim 16, wherein the apparatus comprises an audio output and/or input device, and wherein electronically controlling the shape of the element comprises changing the frequency response of the audio output and/or input device.

20. The method of claim 16, wherein the acoustic transducer comprises a microphone.

21. The method of claim 16, wherein the acoustic transducer comprises a speaker.

22. The method of claim 16 further comprising:

decoding audio data for the acoustic transducer using one of at least two audio codecs; and electronically controlling the shape of the element in dependence on the audio codec used to decode the audio data.

23. The method of claim 20, wherein the apparatus comprises two sound channels coupled to the microphone and configured to provide directional operation of the microphone, wherein electronically controlling the shape of the element comprises electronically controlling the shape of the element to block one of said channels to thereby cause the microphone to operate as an omni-directional microphone.

24. The method of claim 16, wherein the acoustic transducer of the apparatus comprises a microphone array of at least two microphones, each microphone coupled to a respective sound channel, the microphone array configured to provide directional operation, wherein electronically controlling the shape of the element comprises electronically controlling the shape of the element to block one of said channels to thereby cause the microphone array to operate as an omni-directional microphone.

25. The method of claim 21, wherein the apparatus further comprises a microphone located adjacent to the speaker, said method further comprising electrically controlling the shape of the element in dependence upon a signal generated by the microphone.

26. The method of claim 20 further comprising electrically controlling the shape of the element in dependence on a saturation level of the microphone.

27. The method of claim 16 further comprising electrically controlling the element to form a water tight seal within the sound channel based on detection of a risk of water entering the sound channel.

28. The method of claim 16, wherein the element comprises a material in which the shape thereof is modified when a voltage is applied, wherein the material is one of an electrically modifiable material, a piezoelectric material, and a shape memory material.

29. A computer readable memory stored encoded with instructions that, if executed by a computer, perform a process, the process comprising:

in an apparatus comprising an acoustic transducer, and a sound channel coupled to the acoustic transducer, the sound channel comprising an element having a shape within the sound channel, electrically controlling the shape of the element to selectively cause the element to change a shape of the sound channel to thereby change the acoustic properties of the channel based at least on partially changing the dimensions of the element.

* * * * *

UNITED STATES PATENT AND TRADEMARK OFFICE

CERTIFICATE OF CORRECTION

PATENT NO. : 9,294,832 B2
APPLICATION NO. : 12/459233
DATED : March 22, 2016
INVENTOR(S) : Mikko Veli Aimo Suvanto et al.

It is certified that error appears in the above-identified patent and that said Letters Patent is hereby corrected as shown below:

On the Title Page and in the Specification, column 1, the title "Apparatus" should be deleted and --Electronic Device with Changeable Acoustic Properties-- should be inserted.

Signed and Sealed this
Fourteenth Day of June, 2016

Michelle K. Lee

Michelle K. Lee
*Director of the United States Patent and Trademark Office*